United States Patent [19]

Cheek, Jr.

[11] 3,940,181

[45] Feb. 24, 1976

[54] ADJUSTABLE HASSOCK

[75] Inventor: Thomas M. Cheek, Jr., Richmond, Va.

[73] Assignee: Dart Industries, Inc., Los Angeles, Calif.

[22] Filed: Oct. 24, 1974

[21] Appl. No.: 517,727

Related U.S. Application Data

[63] Continuation of Ser. No. 361,824, May 18, 1973, abandoned.

[52] U.S. Cl. ..... 297/439; 108/6; 248/397; 292/265; 292/338; 297/313

[51] Int. Cl.[2] ..... A47C 9/12

[58] Field of Search ..... 297/261, 439, 461, 321, 297/356, 377, 423, 431, 436, 313; 248/396, 397; 108/6; 292/265, 267, 268, 269, 270, 262, 338; 49/356

[56] References Cited

UNITED STATES PATENTS

| | | | |
|---|---|---|---|
| 194,477 | 8/1877 | Smith et al. | 297/377 |
| 470,688 | 3/1892 | Lee | 297/261 |
| 789,813 | 5/1905 | Longley | 297/439 X |
| 1,522,636 | 1/1925 | Landine | 292/268 X |
| 1,550,934 | 8/1925 | Turcotte | 297/439 X |
| 1,622,847 | 3/1927 | Rundgren et al. | 248/397 |
| 3,016,267 | 1/1962 | Cones | 297/439 |
| 3,163,468 | 12/1964 | Koch | 297/439 |

FOREIGN PATENTS OR APPLICATIONS

| | | | |
|---|---|---|---|
| 601,077 | 4/1948 | United Kingdom | 292/265 |
| 10,146 | 6/1896 | United Kingdom | 297/439 |
| 26,429 | 10/1902 | United Kingdom | 248/397 |

*Primary Examiner*—Roy D. Frazier
*Assistant Examiner*—William E. Lyddane
*Attorney, Agent, or Firm*—Kenneth J. Hovet; Leigh B. Taylor; Paul R. Wylie

[57] ABSTRACT

An adjustable lightweight hassock comprising a cushion-like upper seat portion pivotally mounted on a unitary tubular base for angular displacement. The upper seat portion is provided with a movable brace element having a multiplicity of teeth for releasably retaining the seat in a tilted position and including an elongated slot so that when the seat is lowered to a horizontal position, the brace element will become horizontally disposed in an inconspicuous position beneath the seat.

8 Claims, 6 Drawing Figures

ADJUSTABLE HASSOCK

This is a continuation of application Ser. No. 361,824, filed May 18, 1973, now abandoned.

BACKGROUND OF THE INVENTION

1. Field of the Invention

The present invention pertains to furnishings used in the home or other habitable quarters. In particular, the invention concerns a portable footstool or hassock upon which a person may sit or rest the feet and legs.

2. Description of the Prior Art

The use of footstools, ottomans, or hassocks to accomodate ones feet and/or legs have been known for centuries. It was generally considered that physical and mental fatigue can be alleviated in part by relaxing in a sitting position with the feet and legs elevated. Various means have been devised to accomodate ones feet and leg portions including reclining chairs having built-in leg rests, rocking stools, large cushions filled with particulate materials, webbed frames and all other manner of devices to match the decorative scheme of ones home.

To obtain a relatively broad support for ones legs it became desirable to adjust the footstool, ottoman or hassock to conform to the angularity of a persons legs. U.S. Pat. Nos. 470,688, 2,838,097, 2,838,098, 2,994,364 and 3,163,468 are illustrative of the prior art embodying various means to angularly adjust the leg supporting surfaces. These hassocks and their accompanying adjustment means have been unsatisfactory because they were complicated to operate, expensive to produce, and frequently awkward and cumbersome to move. Additionally, the prior art adjustment means were unreliable in maintaining the desired angle of elevation or incline and the adjustment mechanisms were exposed, unprotected or not shielded which created an unsightly and frequently unsafe or hazardous condition.

SUMMARY OF THE INVENTION

In accordance with the present invention, a portable lightweight adjustable hassock is provided which overcomes the various problems associated with prior art hassocks. The present invention comprises a unitary base frame upon which is rotatably mounted a cushion-like seat portion. The seat portion is provided with a depending movable brace element having downwardly inclined teeth sections which engage a stationary detent on the base frame for retaining the seat in various angular positions. The brace or rack element is provided with an elongated slot so that when the seat is in a fully retracted position the element will be disposed in a horizontal position substantially beneath the seat with the teeth pointing toward the underside of the seat. In this manner, the potentially hazardous brace element is not exposed for possible harm to children, the user, or snagging ones clothing. Additionally, the hassock of the present invention presents a more pleasing appearance while retaining the advantages of strength, durability and simplicity of operation.

DESCRIPTION OF THE PREFERRED EMBODIMENT

Figure 1:
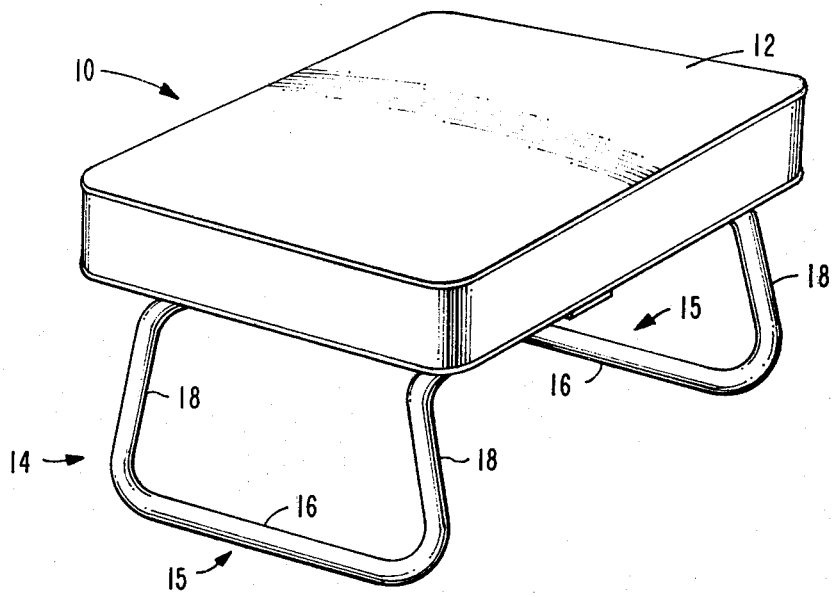
FIG. 1 is a perspective view of a hassock constructed in accordance with the present invention with the seat portion in a closed or fully retracted position.
Figure 2:
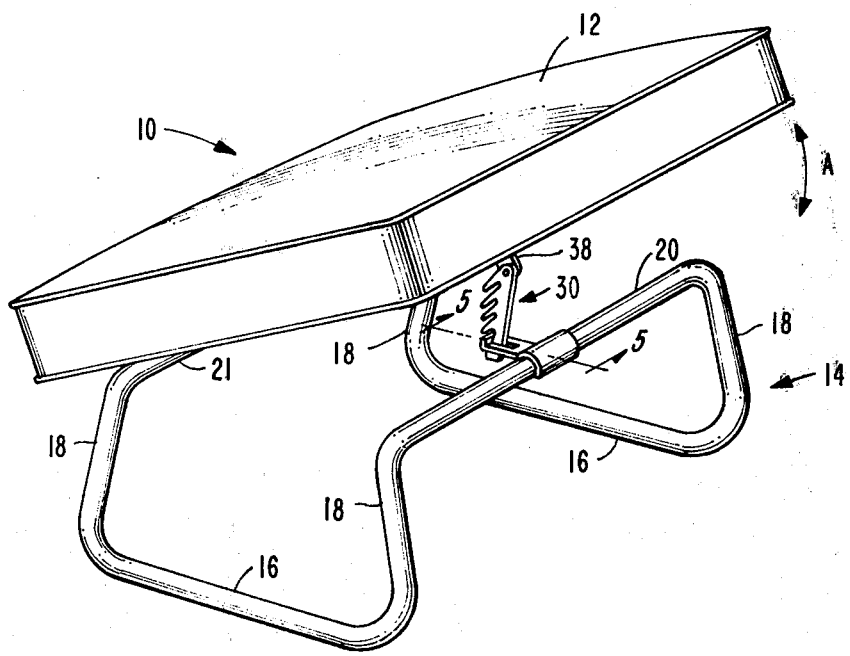
FIG. 2 is a perspective view of the hassock constructed in accordance with the present invention with the seat portion in an open or tilted position.
Figure 3:
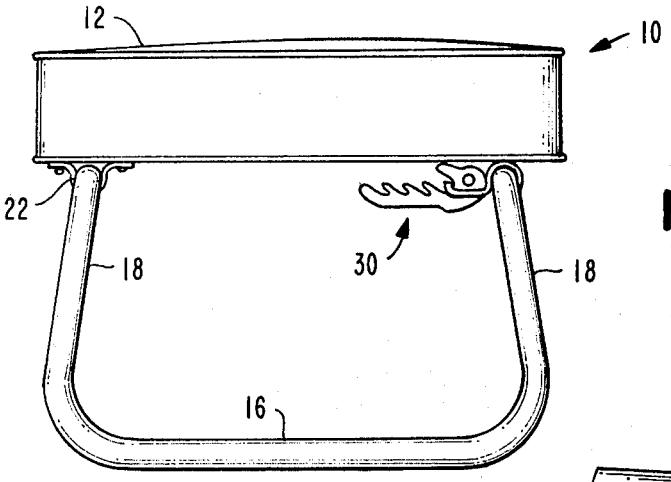
FIG. 3 is a side elevation view of the hassock of FIG. 1.
Figure 4:
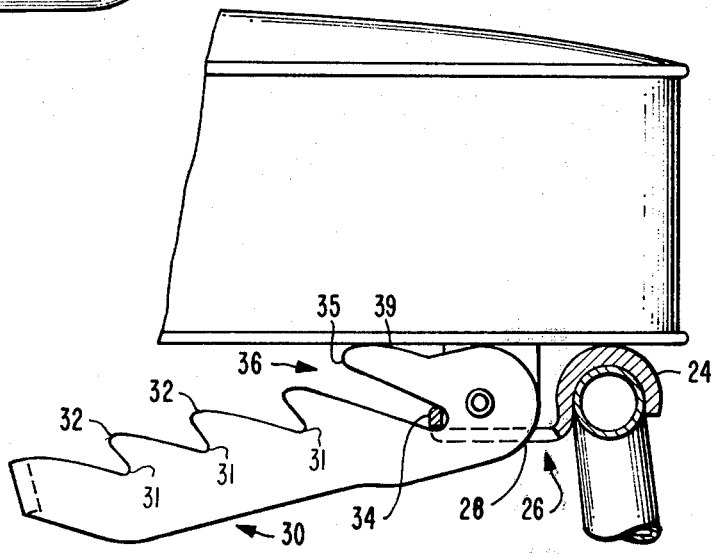
FIG. 4 is a detailed enlarged fragmentary view of FIG. 3 partially broken away.

Referring now to the drawings and more particularly to FIGS. 1–6, there is shown an adjustable hassock 10 in accordance with the present invention. The hassock 10 includes a relatively soft cushion-like seat portion 12 and an open framework base 14. The base 14 is advantageously made out of a tubular material and formed of a continuous length of material such as metallic tubing. However, other materials may be utilized such as wood and plastics in conjunction with other cross-sectional shapes.

As illustrated in the drawings, the tubing is formed to have lower side portions provided with a base length 16. From the ends of the base lengths 16 the tubing curves upwardly into integral upright lengths 18. There are four upright lengths 18 defining the legs of the hassock. The legs are each inclined towards each other by extending inwardly from the lower portions 15. The legs also extend inwardly from the front and rear of the hassock over and above the base length 16.

Each of the upright legs 18 are preferrably of equal length and opposing pairs are joined across the rear and front of the hassock by cross members 20 and 21, respectively. The cross members 20–21 are preferrably of equal length and integral with the upper ends of the upright lengths 18 so that a continuous unitary base support 14 is formed.

Figure 6:
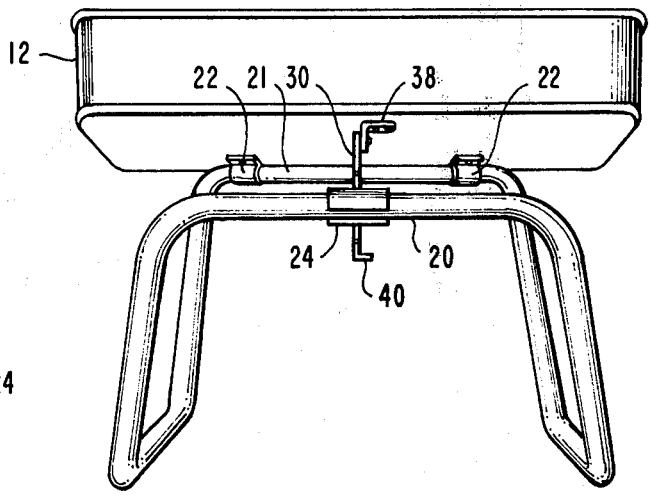
FIG. 6 is a rear elevation view of the hassock of FIG. 2.

As best shown in FIG. 6, seat portion 12 is pivotally connected to cross member 21 by brackets 22. Brackets 22 connect the cushion 12 to base 14 and are loose enough so that the cushion 12 may rotate in an angular direction, shown by arrow A in FIG. 2, about cross member 21.

The retaining assembly of the present invention includes detent means 24 fixedly connected to cross member 20 proximate the midpoint thereof and includes an integral laterally extending member 26 having an elongated aperture 28 provided therein through which brace element 30 freely extends. Brace element 30 is provided with a multiplicity of teeth 32 with indented portions 31 which are adapted to engage the detent portion 34 of detent means 24. The brace element is pivotally journaled about pin 37 to angle part 38 so that it is free to swing beneath cushion 12 in a direction perpendicular to cross member 20.

A unique aspect of the present invention is the provision of elongated open ended slot 36 in brace element 30 at the uppermost end of the brace element adjacent pivot pin 37 and the underside of cushion 12. The slot extends angularly from the brace element edge 39, which generally faces the seat 12, toward pin 37 a distance substantially greater than the indented portions 31 of teeth 32. The slot terminates at closed end 33 which is located adjacent pin 37 and is closer thereto than open end 35. When the cushion is moved to a fully closed position, the slot 36 will serve as a guide in cooperating engagement with detent 34, which acts as a secondary pivot point, to cause the rack element to rotatably slide thereabout into a substantially horizontal position completely beneath cushion 12.

Additionally, the lower end of brace element 30 is provided with a transversly extending tab 40. The purpose of the transversly extending bottom tab is to prevent the inadvertent withdrawal of the brace element through elongated aperture 28. It can be seen that the tab provides a maximum angular displacement of cushion 12 and will allow one to pick-up the hassock by grasping the cushion without fear that it will become disengaged from the base frame.

In operation, it will be apparent that when cushion 12 is in a fully retracted or closed position, the under-surface thereof will be resting on cross members 20–21 with the elongated slot 36 of brace element 30 engaged with detent 34. The slot 36 is disposed within the brace element in a manner such that when the slot slidably engages detent 34 it will pivot the element and cause it to rotate about pin 37 in the direction shown by arrow C in FIG. 5. Once one engages detent 34 with slot 36 the weight of the cushion 12 will automatically cause the rack to swing to a safe inconspicuous position beneath the cushion. To subsequently raise the cushion to a tilted position, one simply grasps the rear end thereof and lifts in the upwardly direction indicated by arrow A in FIG. 2. The brace element will swing in the reverse manner from that described above and as the cushion is further lifted the rack at slot 36 will become disengaged from detent 34. At his point the rack will hang freely by gravity within the constraints of elongated aperture 28.

Figure 5:
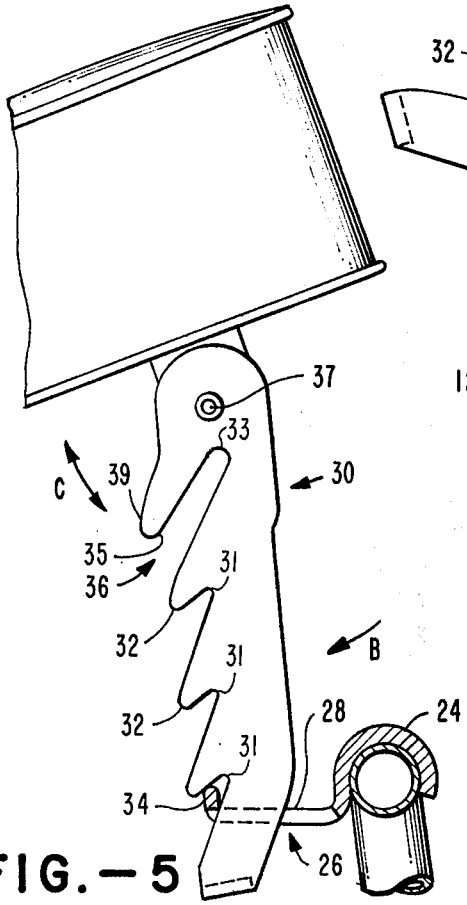
FIG. 5 is an enlarged fragmentary sectional view taken along lines 4—4 of FIG. 2.

One can continue raising the cushion to the desired angular disposition and maintain it there by simply swinging the rack in the direction shown by arrow B in FIG. 5 and letting the cushion down so that a tooth 32 corresponding to the desired level will engage detent 34. The downwardly directed teeth and weight of the cushion serve to securely maintain the engagement of the teeth 32 with detent 34. From the above, it is clear that the cushion may be raised to various positions relative to the base simply by raising or lowering the front of the cushion and engaging the teeth 32 upon detent 34.

Because the base portion is of unitary design without the necessity of unsightly bracing means or cross pieces or other reinforcements the present invention provides a lightweight but sturdy portable hassock. Additionally, a safe and simply operated retaining assembly is provided which allows the hassock cushion to be tilted into various angular positions thereby providing the maximum in comfort to ones legs while providing a safe attractive asset to the decorative scheme of ones living quarters.

I claim:

1. An adjustable hassock comprising:

a unitary base;

detent means connected to said base; and, a seat portion rotatably mounted on said base including a movable brace element pivotably attached to said seat having a multiplicity of teeth with indented portions for releasably retaining said seat on said detent means, said element having an inner edge which generally faces said seat and an elongated open ended slot disposed at an end thereof adjacent said seat for slidably guiding said element on said detent means to a position beneath said seat when said seat is placed in a closed position; said slot extending angularly from an open end at said edge a distance substantially greater than the indented portions toward a closed end at a location adjacent where said brace element is pivotably attached.

2. The hassock of claim 1 wherein said detent means includes an aperture through which said brace element freely extends and a detent portion which releasably engages the teeth of said brace element for retaining said seat in a tilted position.

3. The hassock of claim 1 wherein the teeth of said brace element are disposed thereon to point toward the underside of said seat when said seat is in a closed position.

4. The hassock of claim 1 wherein said base comprises a continuous length of material having two equal base lengths at opposing side portions integral with four upright lengths joined by two opposing cross members.

5. The hassock of claim 4 wherein said detent means is connected to one of said cross members and said seat portion is mounted on the other of said cross members.

6. The hassock of claim 5 wherein said upright lengths are of equal height and extend inwardly toward each other and above said base lengths.

7. In combination:

a base frame having at least two upper cross members;

a cushion pivotally connected to one of said cross members;

a retaining assembly connected to a second of said cross members and to said cushion, said assembly comprising:

detent means fixedly attached to said second cross member; and, a toothed brace element with indented portions pivotally attached to said cushion and positioned to releasably engage said detent means, said element having an inner edge which generally faces said cushion and an elongated open ended slot disposed at one end thereof to engage said detent means and rotatably guide said element to a substantially horizontal position beneath said cushion when said cushion is moved to a closed position; said slot extending angularly from said edge a distance substantially greater than the indented portions toward a closed end at a location adjacent where said brace element is pivotably attached.

8. The combination of claim 7 wherein said element includes a transversely extending tab located at the lower end thereof.

* * * * *